US005647257A

United States Patent [19]

Maida et al.

[11] Patent Number: 5,647,257

[45] Date of Patent: Jul. 15, 1997

[54] METHOD AND PROCESS FOR MANUFACTURING EXPANDABLE PACKING MATERIAL

[75] Inventors: Richard C. Maida, Staten Island; Joseph Sferlazza, West Hempstead, both of N.Y.

[73] Assignee: Prompac Industries, Inc., Staten Island, N.Y.

[21] Appl. No.: 319,507

[22] Filed: Oct. 6, 1994

Related U.S. Application Data

[63] Continuation of Ser. No. 213,993, Mar. 15, 1994, Pat. No. 5,365,819, which is a continuation of Ser. No. 994,708, Dec. 22, 1992, abandoned.

[51] Int. Cl.[6] ..... B26D 1/22

[52] U.S. Cl. ..... 83/332; 83/343; 83/659; 29/6.2

[58] Field of Search ..... 83/332, 343, 659, 83/687, 691; 29/6.1, 6.2

[56] References Cited

U.S. PATENT DOCUMENTS

| | | | |
|---|---|---|---|
| 711,416 | 10/1902 | Bradford | 29/6.1 |
| 778,006 | 12/1904 | Brooks | 83/659 |
| 782,977 | 2/1905 | Madden | 29/6.1 |
| 901,772 | 10/1908 | Benson | 29/6.1 |
| 1,912,681 | 6/1933 | Baker | 29/6.2 |
| 1,927,783 | 9/1933 | Chesney | 29/6.1 |
| 4,020,725 | 5/1977 | Climo | 83/691 |
| 4,615,671 | 10/1986 | Bernal | 425/289 |
| 5,001,017 | 3/1991 | Alhamad | 428/573 |
| 5,065,798 | 11/1991 | Alletto | 83/658 |
| 5,088,170 | 2/1992 | Spath | 29/6.1 |
| 5,095,597 | 3/1992 | Alhamad | 29/6.1 |

*Primary Examiner*—Jack W. Lavinder
*Attorney, Agent, or Firm*—Scully, Scott, Murphy & Presser

[57] ABSTRACT

A machine for forming a packing material by positioning a paper material on or adjacent to a die member and forcing a multitude of cutting blades completely through the paper material and into the die member at a multitude of spaced apart locations to form a multitude of slits in the paper material. These slits allow the paper material to be pulled or expanded into a three dimensional shape that is both load bearing and resilient. In a first embodiment, the forming of the packing material is carried out in a flat die press, including upper and lower die members and with the cutting blades secured to the upper die member. In a second embodiment, the forming of the packing material is carried out in a rotary press including upper and lower rotatable rollers and with the cutting blades secured to the upper roller.

5 Claims, 4 Drawing Sheets

METHOD AND PROCESS FOR MANUFACTURING EXPANDABLE PACKING MATERIAL

This application is a continuation of application Ser. No. 08/213,993, now U.S. Pat. No. 5,365,819 which is a continuation of prior application Ser. No. 07/994,708, filed Dec. 22, 1992, now abandoned.

BACKGROUND OF THE INVENTION

This invention generally relates to methods and systems for forming a packing material. More specifically, the present invention relates to methods and systems for making a multitude of small, thin, closely-spaced slits in a flat paper or paper like material that allow that material to be expanded into a three-dimensional shape or form in which the paper material may be used as a cushioning or filler material.

Cushioning or filler materials are often used to protect articles that are being shipped or transported. For instance, an article may be wrapped in a cushioning material and then placed in an envelope or box for shipment. Alternatively, an article inside a box or package may be surrounded with cushioning or filler material to cushion the article during transportation.

Conventional packing materials have several important disadvantages. For example, small, peanut-shaped styrofoam articles and flat plastic sheets impregnated with a multitude of bubbles, referred to as bubble wrap, are commonly used as packing materials. Toxic wastes are produced, however, when these materials are made. In addition, the disposal of these packing materials has become a significant environmental problem. In particular, these materials are not biodegradable; and, at the same time, these packing materials, particularly the styrofoam peanuts, are bulky and it is not generally feasible to store these items for reuse. Crumpled newspapers may also be used as a packing material, however, newspapers are often not very effective for this purpose.

Recently, attention has been directed to using expandable paper as a packing material. To form such a packing material, a flat, thin sheet of paper, or paper-like material, is provided with a multitude of rows of small, closely-spaced slits. The slits in adjacent rows are staggered so that the slits in one row extend across the spaces between the slits in an adjacent row. After the slits are formed in the paper, the ends of the paper are pulled apart, and this pulls the paper into a three-dimensional shape comprised of a multitude of six-sided cells. In the direction perpendicular to the original plane of the paper, the expanded paper material is both load-bearing and resilient, and the paper, hence, makes a very good cushioning or packing material. For instance, the expanded paper can be wrapped around an article to protect that article during shipment, or the expanded paper can be placed in a box or container, under and around another article, to cushion that article.

It has been found that, in order for the paper to expand properly, it is necessary that virtually every slit must be cut completely through the paper over substantially the entire length of the slit. Typically, though, such thorough or complete cutting is not obtained with prior art high speed, automated die cutting or stamping processes; and, instead, with these prior art processes, numerous small connections remain across a cut or slit. These small connections prevent a paper, having a multitude of rows of slits as discussed above, from expanding into the desired uniform, three-dimensional shape that is needed to achieve the necessary combination of flexibility and load bearing strength.

SUMMARY OF THE INVENTION

An object of this invention is to improve processes for forming packing materials.

Another object of the present invention is to provide a high-speed, automated process for forming an expandable material made of a paper of paper-like material.

A further object of this invention is to form a multitude of closely spaced rows of slits in a flat paper material, which allow that material to be expanded into a three dimensional shape, and to cut virtually every slit completely through the paper over substantially the entire length of the slit.

Still another object of the present invention is to use a multitude of cutting blades to shear completely through a flat paper material at a multitude of locations to form a multitude of closely spaced rows of slits in the paper material.

Another object of this invention is to provide a rotary die press that continuously produces expandable packing material of the type that contains a multitude of closely spaced rows of slits, and that also cuts virtually every slit completely through the paper over substantially the entire length of the slit.

These and other objectives are attained with a process for forming a packing material, comprising positioning a paper material on or adjacent to a die member, and forcing a multitude of cutting blades completely through the paper material and into that die member at a multitude of spaced apart locations to form a multitude of slits in the paper material. These slits allow the paper material to be pulled or expanded into a three-dimensional shape.

In a first embodiment, the process is carried out in a die press, including upper and lower die members. With this embodiment, the paper material is placed on the lower die member, the cutting blades are secured to the upper die member, and the two die members are brought together to force the cutting blades through the paper material and into the lower die member, forming the desired slit pattern in the paper material. Preferably, the lower die member forms a multitude of recesses to receive the cutting blades as they pierce through the paper material, helping the blades shear completely through the paper material along the entire length of each slit.

In a second embodiment, the process of this invention is carried out in a rotary press, including upper and lower rotatable rollers. In this embodiment, the cutting blades are secured to the upper roller, and the rollers are rotated to draw the paper material between the rollers and to force the cutting blades through the paper material and into the lower roller, thereby forming the desired slit pattern in the paper material. The lower roller preferably forms a multitude of recesses to receive the cutting blades as they cut through the paper material, facilitating completely shearing through the paper material along the entire length of each slit.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
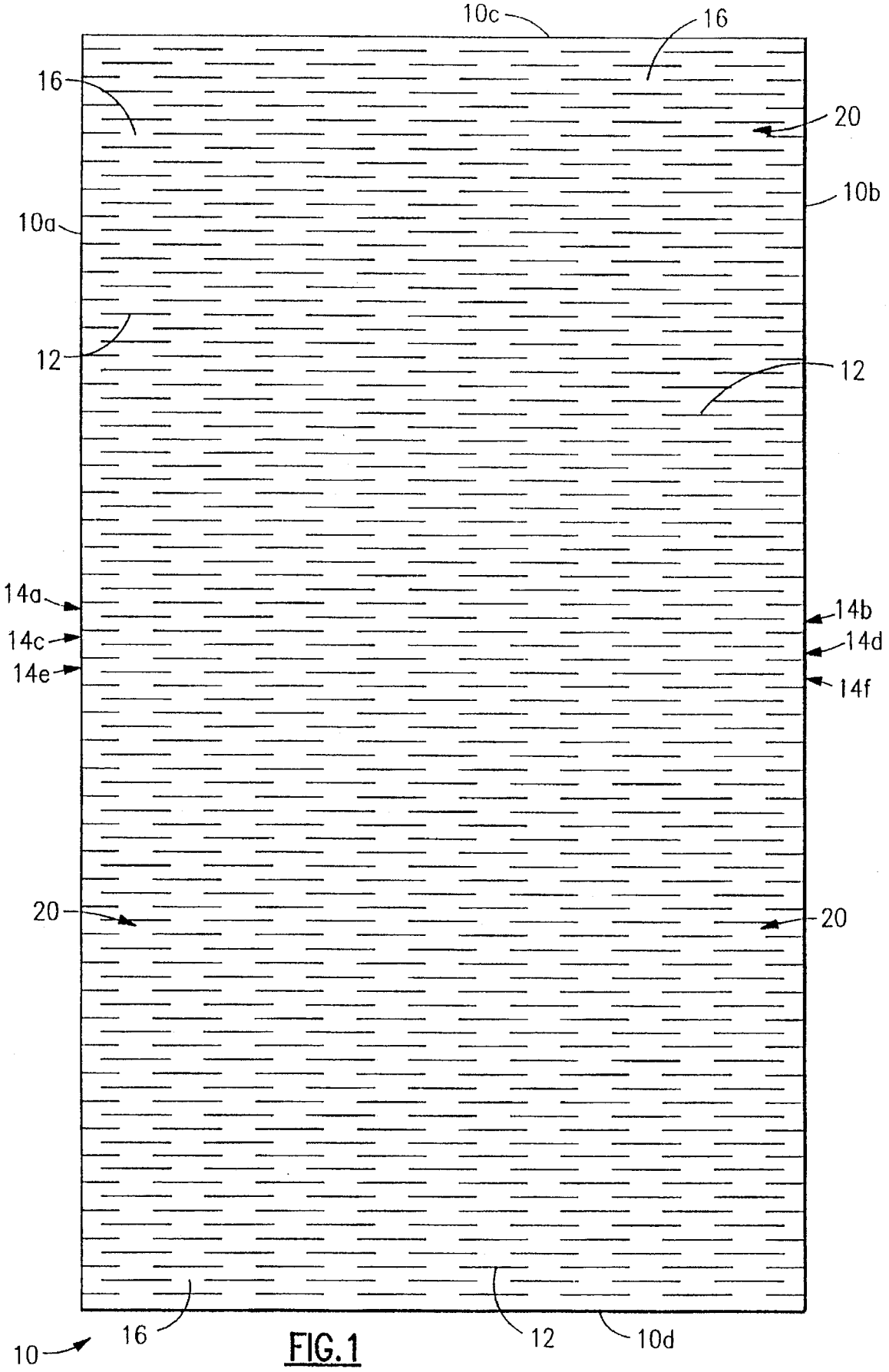
FIG. 1 is a top view of a slit sheet of a paper material made in accordance with the present invention.

FIG. 1 illustrates sheet 10 of a paper or paper-like material having a multitude of slits 12 arranged in a multitude of parallel rows. Six of these rows are referenced in FIG. 1 at 14*a*–14*f* respectively. The slits 12 are positioned so that the slits of one row extend across the intervals or spaces between the slits of the adjacent row, producing a staggered arrangement of slits over sheet 10. Preferably, all of the slits have the same lengths s. In addition, along the transverse axis of sheet 10, the slits are uniformly spaced apart; and along the longitudinal axis of sheet 10, the rows of slits are also uniformly spaced apart.

The rows of slits in sheet 10 can be considered as being comprised of two groups. The slits in the rows of each group are directly aligned with each other in the direction of the longitudinal axis of sheet 10, and the rows of slits in sheet 10 alternate between rows of the first group and rows of the second group. Thus, for example, rows 14*a*, 14*c*, and 14*e* are in the first group of rows; and rows 14*b*, 14*d*, and 14*f* are in the second group of rows. The rows are positioned in sheet 10, for example, with row 14*b* between rows 14*a* and 14*c*, with row 14*c* between rows 14*b* and 14*d*, and with row 14*d* between rows 14*c* and 14*e*.

More specifically, sheet 10 has a generally rectangular shape, including, as viewed in FIG. 1, generally parallel left and right sides or edges 10*a* and 10*b*, and generally parallel top and bottom sides or edges 10*c* and 10*d*. Each row of slits transversely extends across sheet 10, between edges 10*a* and 10*b*, and the sheet forms a short land 16 between each pair of transversely adjacent slits. Because the slits are uniformly spaced apart, all of the lands 16 have the same length $d_1$. Sheet 10 also form a land 20 between each pair of adjacent rows of the slits; and because the rows are uniformly spaced apart, all of the lands 20 have the same width $d_2$.

Although preferably all of the slits have the same length, that length may vary over a wide range. Similarly, although the slits are uniformly spaced apart a distance $d_1$, and the rows of slits are uniformly spaced apart a distance $d_2$, those distances $d_1$ and $d_2$ may also vary over wide ranges. For example, with the slot arrangement shown in FIG. 1, the slits are ½ inch long, adjacent slits are transversely spaced apart 3/16 of an inch, and the rows are spaced apart ⅛ inch.

Figure 2:
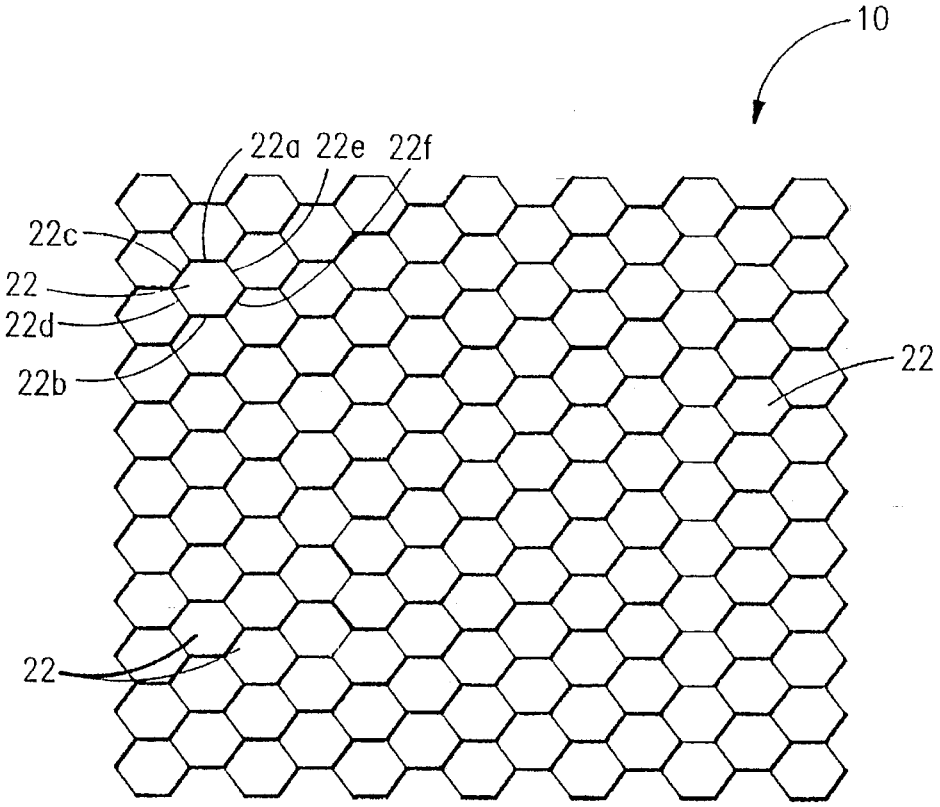
FIG. 2 is a top view of a portion of the paper material of FIG. 1, after that material has been expanded into a three-dimensional shape.

Slits 12 are provided in sheet 10 to allow that sheet to be pulled into a three-dimensional shape comprised of a multitude of hexagonal cells, as shown in FIG. 2. More specifically, with reference to FIGS. 1 and 2, to pull the sheet into this shape, edges 10*c* and 10*d* are pulled apart along the longitudinal axis of the sheet. As this happens, each slit 12 is pulled open into a hexagonal cell 22; and the land segments 20 on opposite sides of each slit are pulled apart, twisted into a direction approximately 45° to the original plane of sheet 10, and also pulled into a shape forming the sides of the hexagonal cell formed from that slit.

The lengths $d_3$ of the top and bottom edges 22*a* and 22*b* of that hexagonal cell 22 are each equal to the length of land 16; and the length $d_4$, of each of the other four sides 22*c*, 22*d*, 22*c* and 22*f* of the hexagonal cell 22 is equal to ½ the length of the slit minus the length of land 16; that is, $d_4$ ½ $(s-d_1)$. With the specific size and arrangement of slits 12 in sheet 10, that sheet forms a honeycomb shape when it is expanded, in which each of the cells 22 is comprised of six equal length sides. As will be understood by those of ordinary skill in the art, the sides of cells 22 may have unequal lengths.

Figure 3:
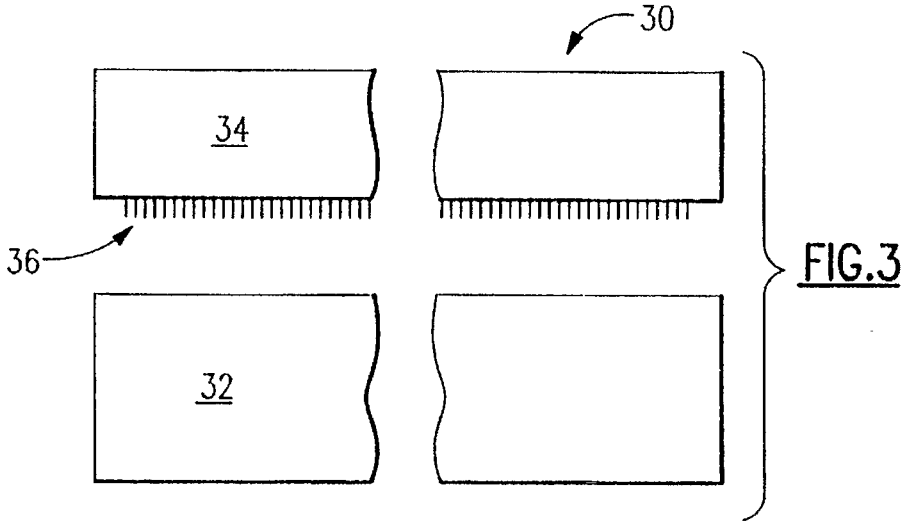
FIG. 3 illustrates a die press used to make the slit material of FIG. 1 in accordance with a first embodiment of the present invention.

As discussed above, it has been found that, in order for sheet 10 to expand properly into the desired three-dimensional shape, it is essential that virtually every slit 12 of sheet 10 be cut completely through the sheet over substantially the complete length of the whole slit. FIG. 3 illustrates die press 30 that effectively does this. Generally, press 30 includes lower member 32, upper member 34, and a multitude of cutting blades 36. Preferably, member 32 includes a lower platen 40 and a top anvil 42, and cutting blades 36 are secured to member 34 and extend outward and downward therefrom.

Figure 4:
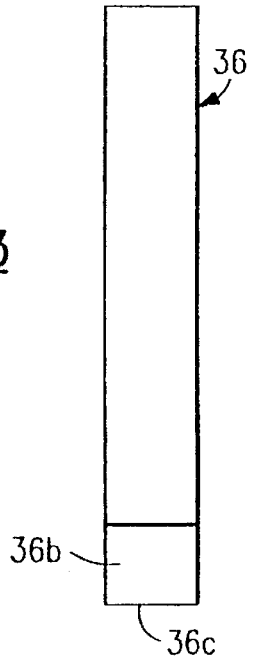
FIG. 4 is a front view of one of the cutting blades of the die press.
Figure 5:
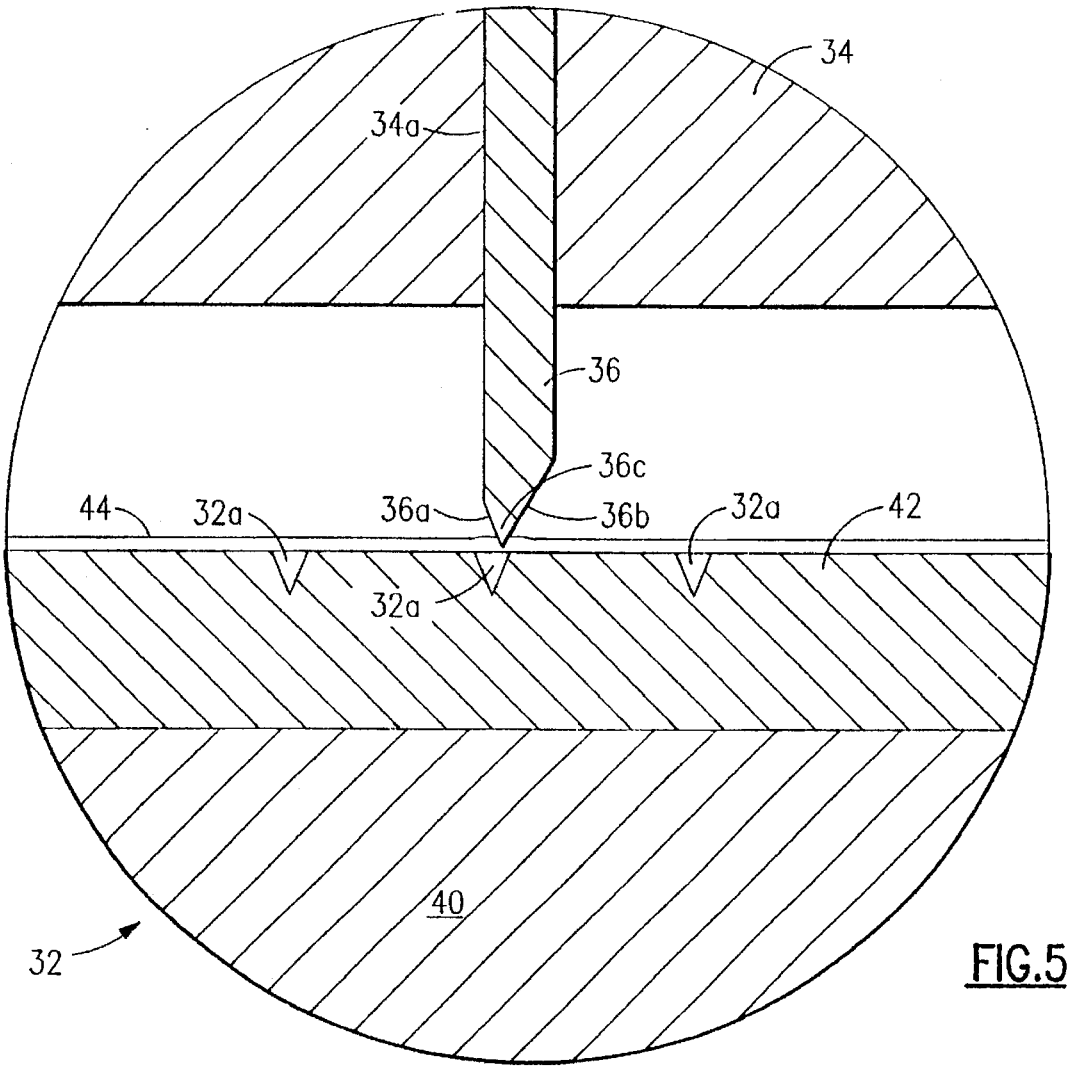
FIG. 5 is an enlarged view of a portion of the press shown in FIG. 3.

Cutting blades 36 are substantially identical, and FIGS. 4 and 5 illustrate one blade in greater detail. As shown in FIG. 4, each blade 36 has a generally rectangular shape, and the cutting blade has tapered front and back surfaces 36*a* and 36*b* that meet to form a cutting edge 36*c*. Blades 36 are secured to upper die member 34 in any suitable manner; and for example, the cutting blades may be press fit into complementary shaped recesses 34*a* in the bottom of member 34 and held in place therein by means of a friction fit between the blades and the surfaces of die member 34 forming those recesses 34*a*.

In the operation of die press 30, a sheet of paper or paper-like material 44 is placed on lower member 32; and then the die press is closed, forcing blades 36 completely through paper 44 and into lower die member 32 to form the slits 12 in the paper. As will be understood by those of ordinary skill in the art, blades 36 are positioned along upper die member 34 so as to form the desired pattern of slits 12 in paper 44.

It is important that blades 36, specifically the lower cutting portions thereof, go completely through paper 44, thereby completely shearing the paper over the entire length of each slit 12. To facilitate movement of the blades completely through paper 44, bottom die member 32 is preferably provided with a multitude of recesses 32*a* that allow the cutting blades, specifically the cutting portions thereof, to pass completely through and to a position below the bottom of paper 44. More particularly, a respective one recess 32*a* is located directly below each cutting blade 36 to receive the cutting portion of the blade as that cutting portion passes through paper 44.

Preferably, recesses 34*a* are formed by blades 36 themselves as die press 30 is closed. To elaborate, preferably, recesses 32*a* are not present in die member 32 when die press 30 is initially assembled, and those recesses are formed by closing the die press to force the cutting blades 36 into the top surface of the lower die member. This may be done prior to using press 30 to slit any sheets of paper, in a process referred to as make ready. Alternatively, recesses 32*a* may be formed during the initial operation of the die press. To facilitate the formation of recesses 32*a*, lower die member 32 is preferably provided with a top anvil 42 of the type referred to in the art as a soft anvil.

Anvil 42 may be made of any suitable material, and the important consideration is simply that the anvil be soft enough so that blades 36 will form recesses 32*a* in the anvil when the die press 30 is closed. For example, anvil 42 may be made from aluminum, brass, polyvinylchloride, polypropylene, or vulcanized fiberboard. If anvil 42 is made from aluminum, the aluminum may be of the type referred to in the art as dead soft and having a hardness less than 200 Brinell. If the anvil is made from polyvinylchloride, the anvil may have a hardness between D72 and D82 as measured on the Shore D scale.

Alternately, recesses 32*a* may be pre-formed in die member 32 before the press 30 itself is assembled. As mentioned above, it is preferred, however, to use cutting blades 36 to form recesses 32*a* after the die press is assembled, since this preferred procedure eliminates the need to ensure that any pre-formed recesses are formed precisely at the required position in die member 32 and then precisely aligned with the cutting portions of blades 36.

Die member 34 and cutting blades 36 also may be made of any suitable materials. For example, die member 34 may be made of wood, or this die member may be made of polymer die boards. Cutting blades 36 may be made of an extremely high tempered steel having a hardness between C53 and C63, and more preferably between C53 and C56, on the Rockwell scale.

Die press 30 may be closed in any suitable manner, and preferably the top die member 34 is held stationary while die member 32 is moved upward to close the die press. Alternatively, the two die members 32 and 34 may both be moved toward each other, or bottom member 32 may be held stationary while top member 34 is moved downward. Preferably, the two die members are brought together at a pressure of 480 to 500 tons per impression. Movement of the lower die member 32 is preferably stopped when that die member reaches the desired final position. Any suitable means may be used to support the die members 32 and 34; and, likewise, any suitable means may be employed to move the lower die member, and for instance, a mechanical support and reciprocating assembly (not shown) may be employed for this purpose.

Figure 6:
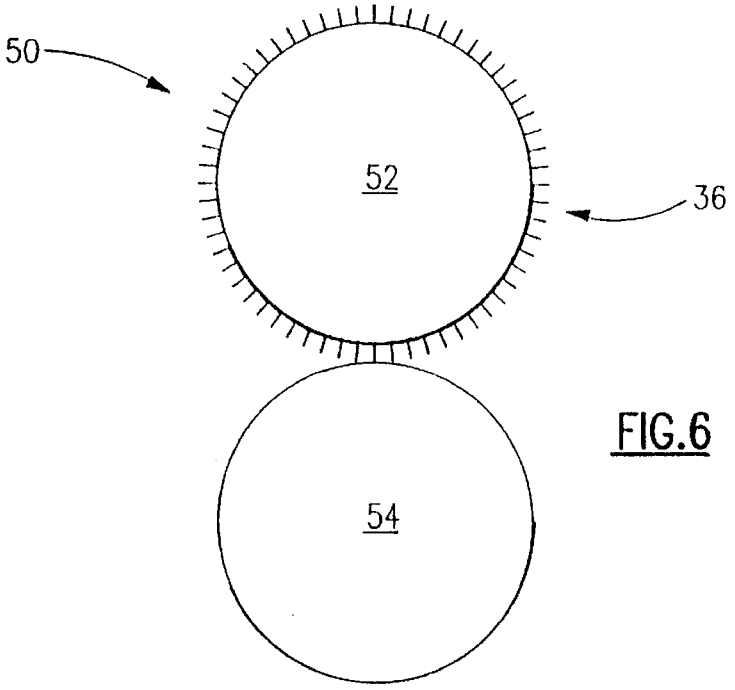
FIG. 6 illustrates a rotary press that may also be used to produce the slit material of FIG. 1 in accordance with an alternate embodiment of this invention.
Figure 7:
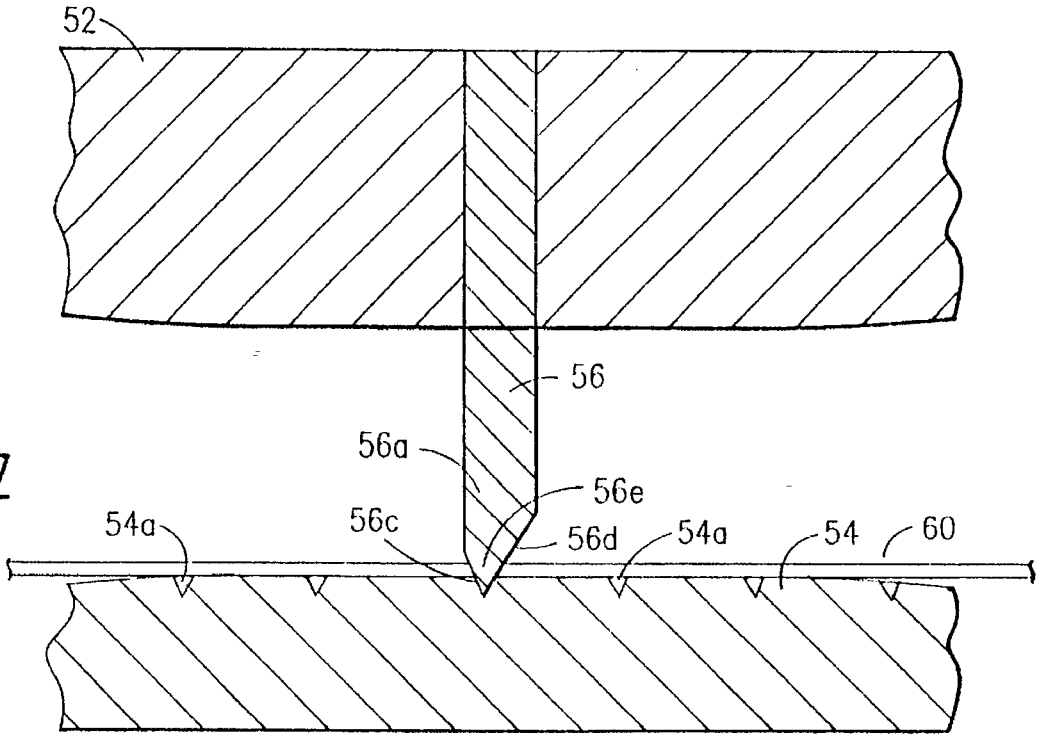
FIG. 7 is an enlarged view of a portion of the rotary press.

FIGS. 6 and 7 illustrate a rotary press 50 that may also be employed to manufacture slit paper material 10; and, generally, press 50 includes first and second rollers 52 and 54 and cutting blades 56. Each roller 52, 54 includes an outside circumferential surface and is supported for rotation about a respective axis, and blades 56 are connected to and extend radially outward from roller 52. Preferably, each roller 52, 54 is comprised of a body and an outside, removable cover or sleeve.

Figure 8:
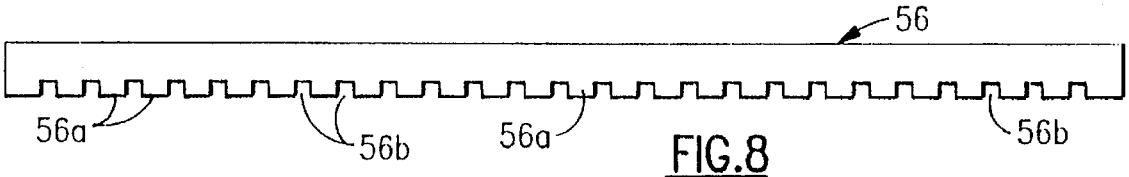
FIG. 8 is a front view of one of the cutting blades used in the rotary press of FIG. 6.

Cutting blades 56 are substantially identical, and FIGS. 7 and 8 illustrate one blade in greater detail. As shown in FIG. 8, blade 36 has an elongated rectangular shape, and the outer portion of the blade forms a multitude of cutting sections 56*a* and a multitude of notches 56*b*, with the cutting sections and the notches alternating with each other along the length of the blade. With reference to FIG. 7, each cutting section has tapered front and back surfaces 56*c* and 56*d* that meet to form a cutting edge 56*e*. Blades 56 are secured to roller 52 in any suitable manner; and for example, these blades may be welded or bolted to the roller.

In press 50, rollers 52 and 54 are supported for rotation about parallel axes and the rollers are slightly spaced apart. Blades 56 are positioned and dimensioned, however, so that as rollers 52 and 54 rotate about their respective axes, the blades, — specifically the cutting sections 56a thereof— engage and extend into roller 54.

In the operation of press 50, rollers 52 and 54 are rotated about their respective axes, and a sheet of paper 60 or paper-like material is fed or passed between the rollers. As this happens, cutting blades 56, specifically sections 56*a* thereof, slice into and completely through that sheet of paper 60 forming slits 12. Blades 56 are arranged on roller 52 so as to form the desired pattern of slits 12 in paper 60.

As mentioned above, it is important that the cutting blades, specifically sections 56*a* thereof, pass completely through paper 60, thereby completely shearing the paper over the entire length of each slit formed by the cutting blades. To accommodate this movement of blades 56 completely through paper 60, roller 54 is preferably provided with a multitude of recesses 54*a* that receive the cutting sections of blades 56, thereby allowing the blades to pass completely through and to a position below the bottom of paper 60. More specifically, recesses 54*a* extend radially inward from the outside surface of bottom roller 54, and these recesses are sized and arranged over that outside surface so that, as rollers 52 and 54 rotate, each time one of the cutting sections 56*a* of blades 56 pierces through paper 60, that cutting section is received in one of the recesses 54*a* of roller 54.

As with recesses 32*a* of the die 30, recesses 54*a* are preferably formed by blades 56 themselves as rollers 52 and 54 rotate. In addition, preferably, recesses 54*a* are not present in roller 54 when press 50 is initially assembled, but those recesses are formed by rotating rollers 52 and 54 to force the cutting sections of blades 56 into the outside surface of roller 54. This may be done prior to using press 50 to slit any sheets of paper, in a procedure referred to as make ready, or recesses 54*a* may be formed during the initial operation of the rotary press.

Because of this, roller 54, or at least the radially outside sleeve or cover thereof, is of the type referred to in the art as a soft anvil. For example, the outside cover of roller 54 may be made of a polyvinyl chloride having a harness between D72 and D82 as measured on the Shore D scale. The outside cover may be made of other materials also; and for instance, the outside cover or sleeve of the roller may be made of aluminum, brass, polypropylene, or vulcanized fiberboard. The inside body of roller 54 may, likewise, be made of any suitable material, such as a tool steel.

Recesses 54*a* may be pre-formed in roller 54, before press 50 itself is assembled. However, preferably cutting blades 56 are used to form recesses 54*a* in the manner described above, because this eliminates the need to make any pre-formed recesses precisely at the required positions and then to assemble rollers 52 and 54 with the precision necessary to ensure that cutting blades 56 rotate into and out of those recesses at the desired times.

Roller 52 and cutting blades 56 also may be made of any suitable materials. For instance, roller 52 may be made of a high chrome tool steel; and blades 56 are preferably made of an extremely high tempered steel having a hardness between C53 and C63, and more preferably between C53 and C56, on the Rockwell scale. In addition, any suitable means or motor, such as an electric motor, may be utilized to rotate rollers 52 and 54. Similarly, any suitable support means, frame or assembly may be used to support rollers 52 and 54 in press 50. Also, as shown in FIG. 6, preferably rollers 52 and 54 have the same diameter, and in use they rotate at the same speed. While these features are preferred, neither is necessary to the present invention.

Figure 9:
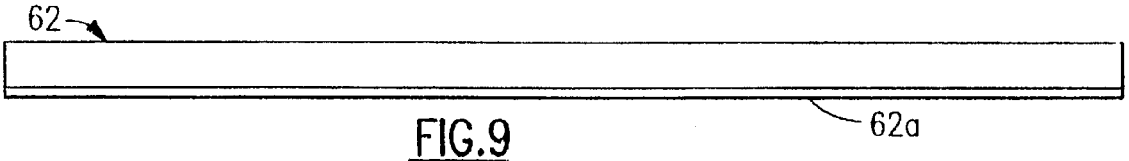
FIG. 9 is a front view of an alternate cutting blade that may be used in the rotary press.

One advantage of roller press 50 is that the press may be used to make a continuous sheet of slit material of indefinite length. That slit material can then be rolled into a cylindrical shape and then sold or shipped in that form, or the slit material can be cut into smaller lengths. Roller press 50 can also be used to make slit material of uniform, predetermined lengths. This may be done, as an example, by replacing one of the blades 56 on roller 52 with another type of blade, as shown at 62 in FIG. 9, that forms a continuous cutting edge 62*a* along its outside length. In use, when this blade 62 engages a paper material in press 50, the edge 62*a* forms a clean slice completely through and across the paper material, cutting the material into shorter segments or pieces. For this reason, preferably at least one of the blades 56 of press 50 is releasably connected to roller 52, to facilitate replacing one of the blades 56 with blade 62 if and when this is desired.

Sheet 10 may be made of a multitude of types of materials. The important consideration is that, when the material is provided with slits 12 and then pulled in a direction perpendicular to the direction of the lengths of those slits, the material expands into a three dimensional shape that is both resilient and load bearing and comprised of a multitude of open hexagonal cells. Preferably, this material is a fibrous, paper material, and the present invention is very well suited for use with recycled paper. For instance, sheet 10 may be a paper material of the type referred to as a zero nip stock, which contains strong, bulky fibers. The strength and weight of the material of sheet 10 may vary wide ranges, though. It is preferred that the lengths of the slits 12 be perpendicular to the direction of the grain of sheet 10.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

We claim:

1. A die press for forming a multitude of spaced apart slits in a flat, thin paper material, comprising:

a lower die member including an upper portion for supporting the paper material, and having a hardness less than 200 Brinell;

an upper die member disposed above the lower die member; and a multitude of cutting blades secured to the upper die member and having a hardness greater than C53 on the Rockwell scale;

wherein the cutting blades are arranged in a series of parallel rows, and in each of said rows, the cutting blades are spaced apart along the row;

wherein the cutting blades form the multitude of spaced apart slits in the paper material and form a multitude of spaced apart recesses in the upper portion of the lower die member, said recesses are aligned with and receive said cutting blades to facilitate movement of the cutting blades completely through the paper material; and whereby the cutting blades cut completely through the thin paper material over substantially the entire length of each slit and the formed slits facilitate expanding the paper material from the flat, thin shape into a honeycomb shape.

2. A die press according to claim 1, wherein each of the cutting blades has a hardness between C53 and C63 on the Rockwell scale.

3. A rotary press for forming a multitude of spaced apart slits in a flat, thin paper material, comprising:

a first roller supported for rotation about a first axis;

a second roller supported for rotation about a second axis, parallel to the first axis, and including an outside portion having a hardness less than 200 Brinell, and wherein the first and second rollers are rotated to draw the paper material between the rollers; and a multitude of cutting blades connected to the first roller for rotation therewith and having a hardness greater than C53 on the Rockwell scale; wherein each of the cutting blades has a longitudinal axis, and includes a multitude of notches and cutting edges, the axes of the cutting blades are parallel to the axes of the first and second rollers; and along the longitudinal axis of each cutting blade, the notches of the cutting blade alternate with the cutting edges of the blade;

wherein the cutting blades form the multitude of spaced apart slits in the paper material as the paper material is drawn between the rollers, and the cutting blades also form a multitude of spaced apart recesses in the outside portion of the second roller for receiving the cutting blades as the rollers rotate;

wherein as the rollers rotate, each of the cutting edges is forced into a respective one of the recesses in the second roller, to facilitate movement of the cutting blades completely through the paper material; and whereby the cutting blades cut completely through the thin paper material over substantially the entire length of each slit and the formed slits facilitate expanding the paper material from the flat, thin shape into a three-dimensional honeycomb shape.

4. A rotary press according to claim 3, wherein each of the cutting blades has a hardness between C53 and C63 on the Rockwell scale.

5. A die press according to claim 4, wherein:

each of the cutting blades has a hardness between C53 and C56 on the Rockwell scale;

each of the cutting blades has an elongated rectangular shape and includes a multitude of cutting sections spaced apart from each other along the axis of the cutting blade; and each of the cutting sections has tapered front and back surfaces that meet to form one of the cutting edges of the cutting blade.

* * * * *